US005961013A

United States Patent [19]

Collins

[11] Patent Number: 5,961,013

[45] Date of Patent: Oct. 5, 1999

[54] SECURITY HOLSTER

[75] Inventor: Jerry L. Collins, Miami, Okla.

[73] Assignee: Don Hume Leathergoods, Inc., Miami, Okla.

[21] Appl. No.: 09/148,803

[22] Filed: Sep. 4, 1998

[51] Int. Cl.[6] ..... F41C 33/02

[52] U.S. Cl. ..... 224/244; 224/911

[58] Field of Search ..... 224/191, 192, 224/242, 243, 244, 245, 232, 911, 912

[56] References Cited

U.S. PATENT DOCUMENTS

| | | | |
|---|---|---|---|
| 468,556 | 2/1892 | Anderson . | |
| 1,046,912 | 12/1912 | Wanee . | |
| 1,113,530 | 10/1914 | Audley . | |
| 1,635,984 | 7/1927 | Corriston | 224/244 |
| 1,851,352 | 3/1932 | Denkert . | |
| 2,001,321 | 5/1935 | Berns . | |
| 2,349,376 | 5/1944 | Ray | 224/244 |
| 3,866,811 | 2/1975 | Hamby . | |
| 3,910,469 | 10/1975 | Baldocchi . | |
| 4,079,870 | 3/1978 | Clark . | |
| 4,084,734 | 4/1978 | Bianchi et al . | |
| 4,256,243 | 3/1981 | Bianchi et al. | 224/244 |
| 4,270,680 | 6/1981 | Bianchi | 224/193 |
| 4,277,007 | 7/1981 | Bianchi et al. | 224/193 |
| 4,287,419 | 9/1981 | Rogers | 224/193 |
| 4,318,503 | 3/1982 | Capano | 224/244 |
| 4,378,082 | 3/1983 | Chica | 224/243 |
| 4,694,980 | 9/1987 | Rogers | 224/243 |
| 5,018,654 | 5/1991 | Rogers et al. | 224/244 |
| 5,129,562 | 7/1992 | Bianchi | 224/244 |
| 5,275,317 | 1/1994 | Rogers et al. | 224/244 |
| 5,284,281 | 2/1994 | Nichols | 224/244 |
| 5,315,761 | 5/1994 | Norton et al. | 224/232 X |
| 5,395,021 | 3/1995 | Brown | 224/244 |
| 5,419,474 | 5/1995 | Marx et al. | 224/244 |
| 5,467,909 | 11/1995 | Resca et al. | 224/244 |
| 5,509,591 | 4/1996 | Carver | 224/244 |
| 5,598,958 | 2/1997 | Ryan, III et al. | 224/243 X |
| 5,810,221 | 9/1998 | Beletsky et al. | 224/244 |

*Primary Examiner*—Allan N. Shoap
*Assistant Examiner*—Gregory M. Vidovich
*Attorney, Agent, or Firm*—William R. Sharp

[57] ABSTRACT

A top draw security holster as described herein is designed to prevent an assailant from drawing a handgun from the holster while allowing one wearing the holster to draw the handgun from the holster in a straight and upward motion after easily and quickly moving a latch control from a latched position to a released position. The latch comprises a flexible and resilient arm integrally connected to a sidewall adjacent to a window in the sidewall, and further comprises a boss integrally connected to the arm. In the released position, the arm is allowed to be in a relaxed state outwardly extending from the sidewall so as to allow insertion of the handgun into the holster or straight and upward drawing of the handgun from the holster. In the latched position, the boss extends through the window and inside the trigger guard so as to prevent drawing of the handgun from the holster.

15 Claims, 3 Drawing Sheets

SECURITY HOLSTER

BACKGROUND OF THE INVENTION

The invention relates to a security holster of the type which is designed to prevent an assailant from drawing a handgun from the holster as worn by, for example, a law officer.

One widely used top draw security holster employs a pair of flexible arms having pyramidal bosses for being received inside the trigger guard. The pyramidally shaped bosses are designed to prevent drawing of the handgun by a straight upward movement, but permit the handgun to be drawn if first moved forward. This forward motion of the handgun prior to upward drawing is an unnatural movement, and must be practiced to ensure proper execution, especially in a dangerous situation in which any hesitation in drawing could lead to disastrous consequences. Moreover, the risk is increased insofar as the required forward motion of the handgun leaves little room for error. The handgun cannot be drawn if it is not moved forward a sufficient distance, or if it is moved forward too far so as to wedge the handgun in the holster. Finally, no two security holsters of this type are exactly the same, due to the nature of their production, thus requiring further practice if one starts using another holster in order to relearn the precise forward motion required for the particular holster being worn.

SUMMARY OF THE INVENTION

It is, therefore, an object of the invention to provide a top draw security holster which is simple and easy to use, thereby requiring minimal training and practice in drawing a handgun from the holster.

The above object is realized by a top draw security holster for a handgun having a trigger guard, wherein the security holster is assumed to be oriented for wearing by a user and comprises: a holster body having a pair of opposing sidewalls, an open top, a back, and an at least partially closed and unopening front, wherein a holster cavity is defined in the holster body and one sidewall has a window adjacent to the back of the holster body; a latch having a flexible and resilient arm integrally connected to said one sidewall adjacent to the window and also having a boss integrally connected to the arm, wherein the arm, when in a relaxed state, extends outwardly from said one sidewall so that at least a portion of the boss is outside of but adjacent to the window; and a latch control means selectively movable between a released position and a latched position, where in the released position the arm is allowed by the latch control means to be in its relaxed state to permit insertion of the handgun into the holster cavity so that the trigger guard is adjacent to the window, and where in moving from the released position to the latched position the latch control means pushes the arm inwardly and the boss inwardly through the window to position the boss inside the trigger guard within the holster cavity so as to prevent drawing of the handgun from the holster cavity, and finally where movement of the latch control means from the latched position back to the released position returns the arm to its relaxed state to allow drawing of the handgun from the holster cavity in a straight and upward motion through the open top of the holster body.

In a preferred embodiment hereafter described, the arm defines an acute angle with respect to the window and the boss has a lower surface which defines an angle of about 90° with respect to the arm. In the latched position, the lower surface of the boss effectively prevents drawing of the handgun from the holster cavity, and in the released position the lower surface of the boss as engaged by the trigger guard pushes the boss outwardly to allow the trigger guard to clear the boss in a straight and uninterrupted upward movement. Therefore, no forward movement of the handgun is required as in the prior top draw security holster as previously described. The latch control means is preferably a thumb break paddle which can be easily and quickly moved from the latched position to the released position in a substantially rearward motion.

Accordingly, the security holster of the invention is very easy to use, requires minimal training and practice, and minimizes the risk of a drawing failure by an officer wearing the holster.

DETAILED DESCRIPTION OF THE INVENTION

The following description assumes that the illustrated security holster is oriented for wearing by a user. Where a member is described as being "integrally connected" to another member, this means that the members are fixedly connected to one another or actually integral with one another.

Figure 1:
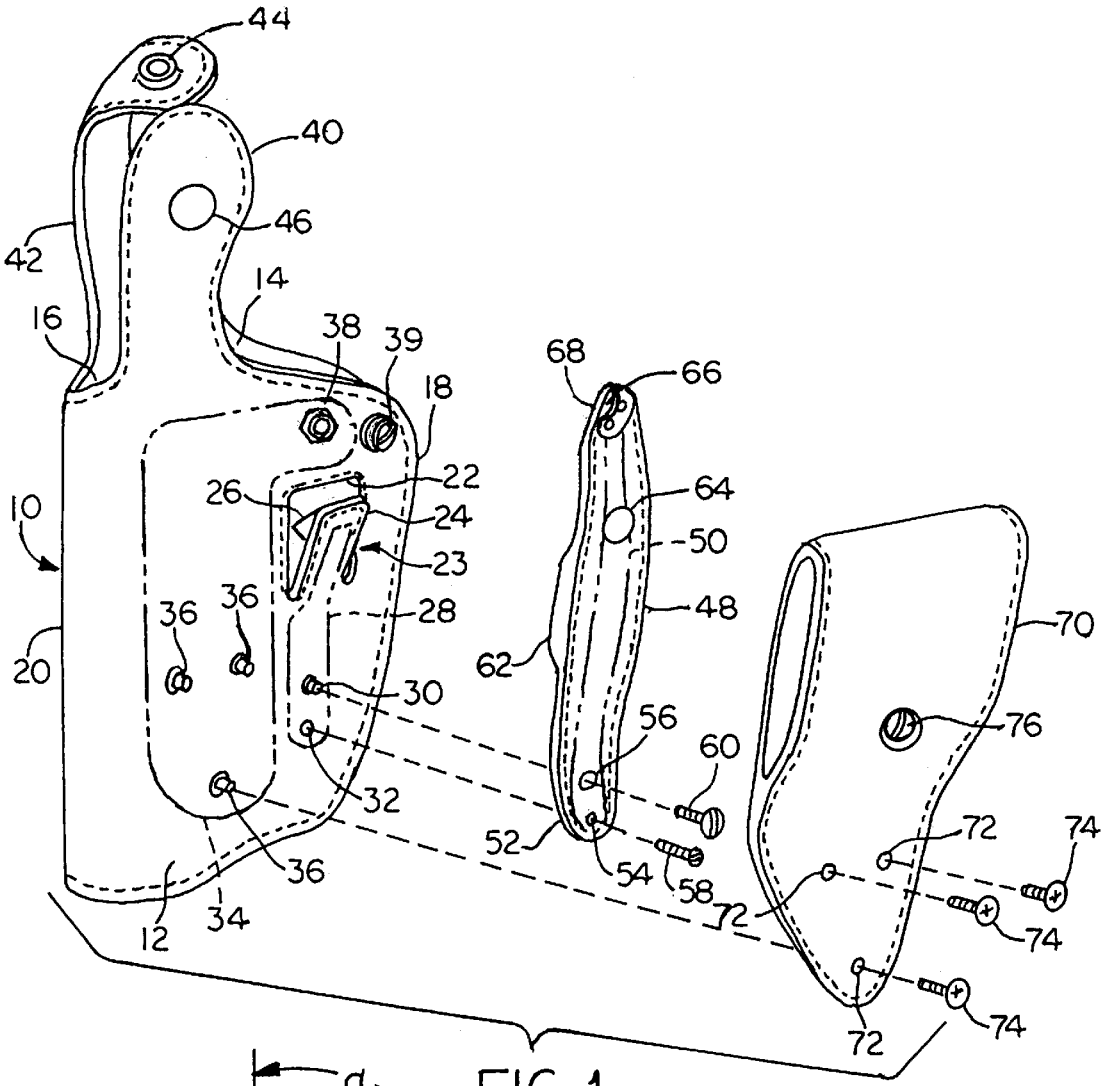
FIG. 1 is a perspective, partially disassembled view of a preferred embodiment of a security holster in accordance with the invention.

Referring to FIG. 1, a holster body 10 is preferably of a leather construction in which inner and outer layers are bonded and stitched together. Holster body 10 has a pair of opposing sidewalls 12 and 14, an open top 16, a back 18, and an at least partially closed and unopening front 20. A holster cavity is defined within holster body 10. In the illustrated embodiment, front 20 is fully closed insofar as it extends to open top 16. Sidewall 12 has a window 22 adjacent to back 18.

A latch 23 comprises a flexible and resilient arm 24 integrally connected to (preferably integral with) sidewall 12 adjacent to window 22, and further comprises a boss 26 integrally connected to the arm. Arm 24 preferably includes the upper portion of a bent spring steel member 28 (indicated by a broken line) interposed between leather layers, as will be discussed further with reference to FIG. 2. Spring steel member 28 provides the desired flexible and resilient properties for arm 24, but other suitably flexible and resilient materials could be used if desired. A lower portion of spring steel member 28 has an internally threaded post 30 extending therefrom through a hole in the outer layer of sidewall 12, and has a hole aligned with hole 32 in sidewall 12.

A rigid, preferably steel, plate 34 (indicated by a broken line) is mounted between the layers of sidewall 12. Three internally threaded posts 36 extend from a lower portion of plate 34 and through holes in the outer layer of sidewall 12. A male portion 38 of a directional snap is affixed to sidewall 12 adjacent to an upper portion of plate 34 immediately above window 22. A reinforcement screw and associated washer are shown at 39.

A thumb break strap 40 is integrally connected to (preferably integral with) sidewall 12 adjacent to front 20, and a restraining strap 42 is integrally connected to (preferably integral with) sidewall 14 adjacent to front 20. A male portion 44 of a snap is affixed to restraining strap 42, and a female portion (not visible in FIG. 1) of the snap is affixed to thumb break strap 40 by means of button 46.

Thumb break paddle 48 is an elongated member preferably having an elongated spring steel member 50 (indicated by a broken line) mounted therein between leather layers. A lower end 52 of paddle 48 has holes 54 and 56 therethrough. Screw 58 is adapted to be received through hole 54 and hole 32 in sidewall 12. An internally threaded post, not visible in FIG. 1, extends from sidewall 14 into the holster cavity for threadedly receiving screw 58. This screw and post connection is designed to allow pivoting of paddle 48 with respect to screw 58, as will be clearly shown in FIGS. 3 and 4. Screw 60 is adapted to be received through hole 56 for threaded connection to post 30. Hole 56 is sized to provide rearward and forward stops for paddle 48 in its rearward (toward back 18) and forward (toward front 20) pivoting motion. An intermediate portion 62 of paddle 48 preferably has a substantially rigid member (not shown) mounted between the leather layers, which accounts for the thickened appearance of intermediate portion 62. Paddle 48, and its associated spring steel member 50, is bent between lower end 52 and intermediate portion 62 so that when paddle 48 is connected to sidewall 12 by means of screws 58 and 60, intermediate portion 62 will contact arm 24 but not place sufficient pressure upon the arm to move it from its illustrated relaxed state. Paddle 48 also has a female portion (not visible in FIG. 1) of the directional snap affixed thereto by means of button 64. Finally, a thumb tab 66 is affixed to the upper end 68 of paddle 48.

Belt shank loop 70 has a lower portion with holes 72 for receiving screws 74 therethrough. Screws 74 are adapted to be threadedly received by posts 36. A belt tension screw 76 is provided to allow adjustment by one wearing the security holster.

Figure 2:
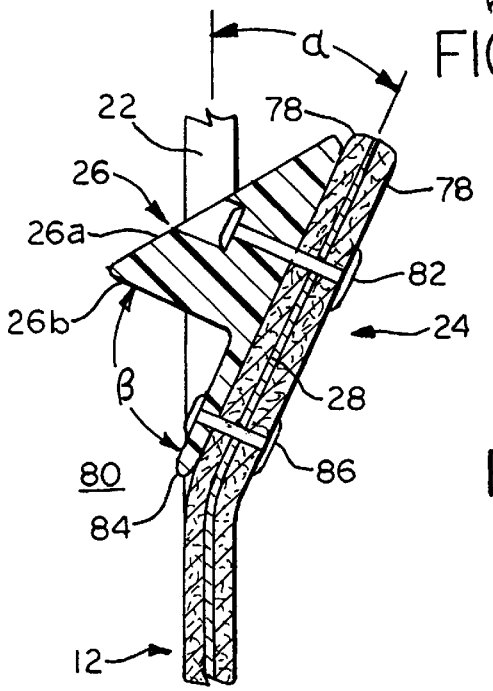
FIG. 2 is an enlarged cross-sectional view of an arm and boss shown in FIG. 1.

Referring to FIG. 2, this enlarged cross-sectional view shows the structure of arm 24 and boss 26 in more detail.

Arm 24, as shown in its relaxed state, extends outwardly from sidewall 12 so that at least a portion of boss 26 is outside of but adjacent to window 22. Arm 24 comprises, as mentioned previously, an upper portion of spring steel member 28 interposed between leather layers 78. An adhesive can be employed to assist in holding spring steel member 28 in place between leather layers 78. Spring steel member 28 is bent at the base of arm 24 so that arm 24 defines an acute angle $\alpha$ with respect to window 22.

Boss 26, preferably a sturdy material (i.e. nylon) which will not scratch the trigger guard of a handgun, has an upper surface 26a extending through window 22 and into holster cavity 80. Upper surface 26a is inclined with respect to window 22 so as to slope generally downwardly in its extension from window 22 into holster cavity 80. Boss 26 also has a lower surface 26b extending through window 22 and into holster cavity 80. Lower surface 26b defines an angle $\beta$ less than or about equal to 90° with respect to arm 24. Angle $\beta$ is most preferably about 90°. In any event, angle $\beta$ and angle $\alpha$ are such that lower surface 26b is inclined with respect to window 22 so as to slope generally upwardly in its extension from window 22 into holster cavity 80. Boss 26 is shown as being connected to arm 24 by a rivet 82. Boss 26 preferably has a depending flange 84 connected to arm 24 by a rivet 86.

Figure 3:
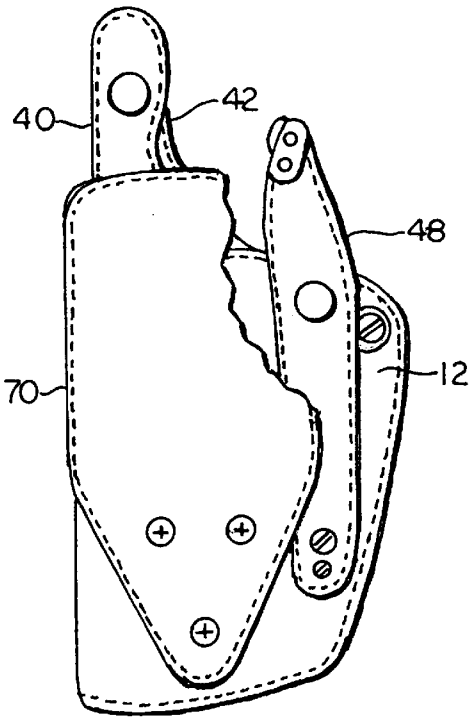
FIG. 3 is a side view of the security holster showing the holster with its paddle in the latched position.

Referring to FIG. 3, the security holster is shown with a portion of belt shank loop 70 broken away to more clearly reveal paddle 48 in its latched position. In such latched position, the male and female portions of the above-mentioned directional snap are mated together to fasten paddle 48 to sidewall 12. Thumb break strap 40 is also shown as being fastened to restraining strap 42 by means of the associated snap.

Figure 4:
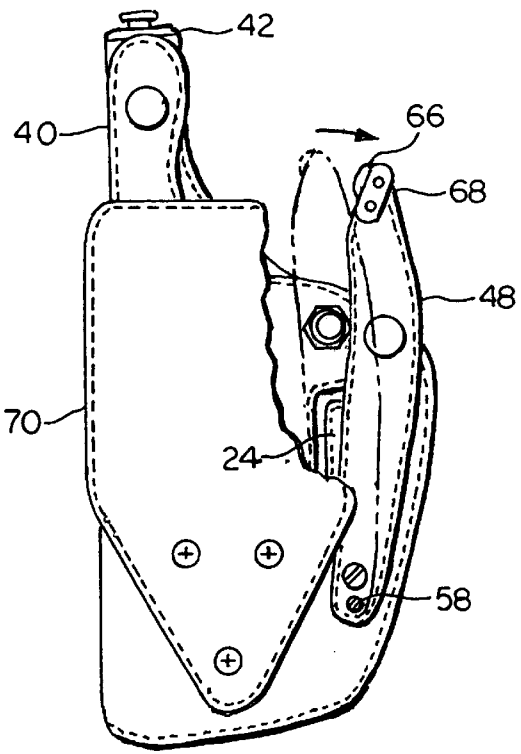
FIG. 4 is a side view of the security holster showing the holster with the paddle in a released position.

Referring to FIG. 4, the user applies his or her thumb against thumb break strap 40 to unsnap such strap from restraining strap 42, and then moves the thumb rearward in a substantially continuous and fluid motion so as to apply pressure to thumb tab 66 and unsnap paddle 48 from its latched position (indicated by a broken line). The substantially rearward motion of the upper end 68 of paddle 48 is indicated by the arrow. The resulting released position of paddle 48 allows arm 24 to be in its relaxed state so as to allow insertion of a handgun into the holster cavity or drawing of the handgun from the holster cavity as will be described with reference to FIGS. 6 and 8.

Figure 5:
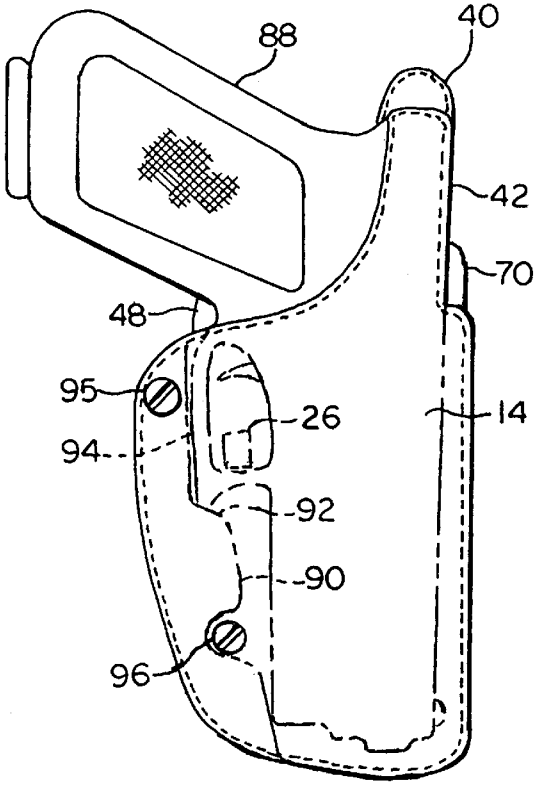
FIG. 5 is an opposing side view of the security holster in the latched position with a handgun secured therein.

Referring to FIG. 5, this FIGURE shows further details of the security holster and the manner in which a handgun 88 is secured therein. An elongated welt 90 (indicated by a broken line) is mounted between the sidewalls, of which only sidewall 14 is shown. Welt 90 has a ledge 92 upon which the bottom of trigger guard 94 rests. Paddle 48, only a small portion of which is visible in FIG. 5, is in the latched position with boss 26 (indicated by a broken line) inside trigger guard 94. Handgun 88 is further secured by restraining strap 42 as fastened to thumb break strap 40. At 95 and 96 are indicated the heads of internally threaded posts which respectively receive screws 39 and 58 (FIGS. 1 and 4).

Referring now to FIGS. 6–9, these FIGURES show different stages in the operation of the security holster with handgun 88. Each of FIGS. 6–9 is a partial rear view with an upper portion of welt 90 above ledge 92 and associated sidewall portions broken away to reveal the positions of boss 26 and trigger guard 94.

Figure 6:
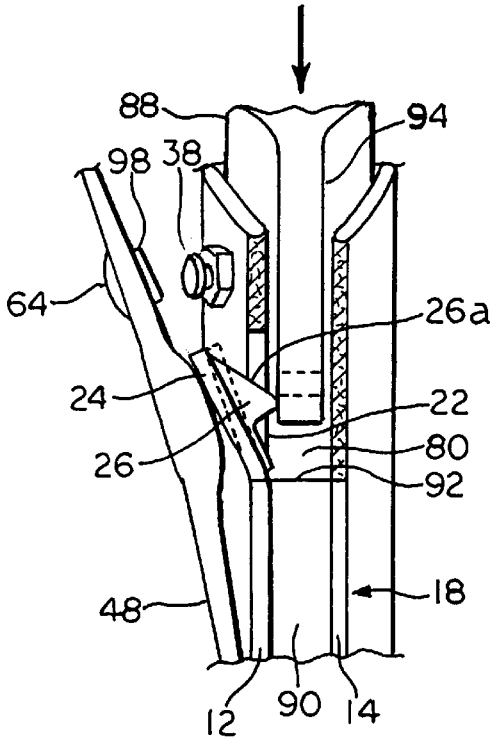
FIGS. 6–9 illustrate the operation of the security holster with the handgun.

Referring to FIG. 6, this FIGURE shows insertion of handgun 88 into holster cavity 80 after having moved paddle 48 to the released position. Handgun 88 is inserted downwardly into holster cavity 80 so that trigger guard 94 is adjacent to window 22. The portion of trigger guard 94 indicated by broken lines engages upper surface 26a of boss 26 to push arm 24 outwardly from its position in the relaxed state (as indicated by a broken line). As further shown in FIG. 6, welt 90 has a ledge 92 as previously described, and also has a rear face which, in conjunction with the rear edges of sidewalls 12 and 14, define back 18. The female portion 98 and its associated button 64, as well as male portion 38, of the directional snap are also shown in FIG. 6.

Figure 7:
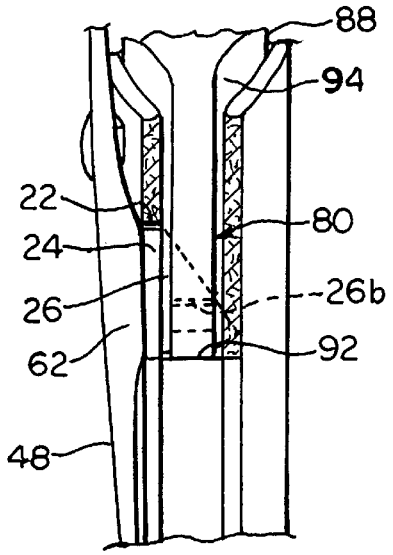

Downward movement of handgun 88 is continued from that position shown in FIG. 6 so that trigger guard 94 clears boss 26 and, referring now to FIG. 7, the bottom of the trigger guard comes to rest on ledge 92. Paddle 48 is then pivotally moved to the extent necessary to position intermediate portion 62 directly over and in contact with arm 24. The user forcibly moves paddle 48 inwardly to push arm 24 and boss 26 inwardly so that arm 24 is parallel to and inside window 22, and substantially the entire boss 26 and its lower surface 26b extend into holster cavity 80. Boss 26 is inside trigger guard 94 with lower surface 26b in contact with or immediately adjacent to the portion of trigger guard 94 indicated by broken lines. The male and female portions of the directional snap are mated together to place paddle 48 in the latched position. In such latched position, in any attempt to draw handgun 88 from the security holster, lower surface 26b of boss 26 engages the above-mentioned portion of trigger guard 94 to prevent drawing from holster cavity 80.

Figure 8:
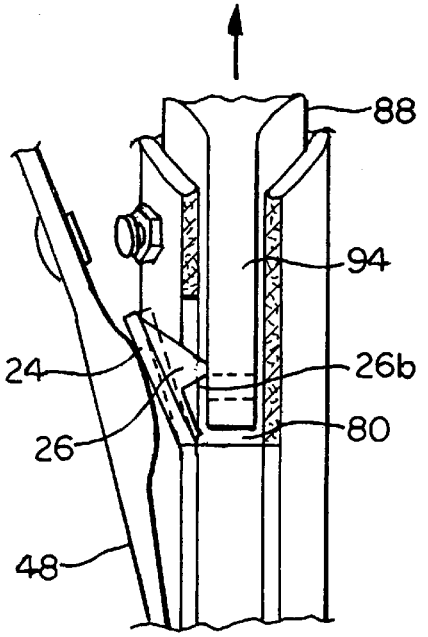
Figure 9:
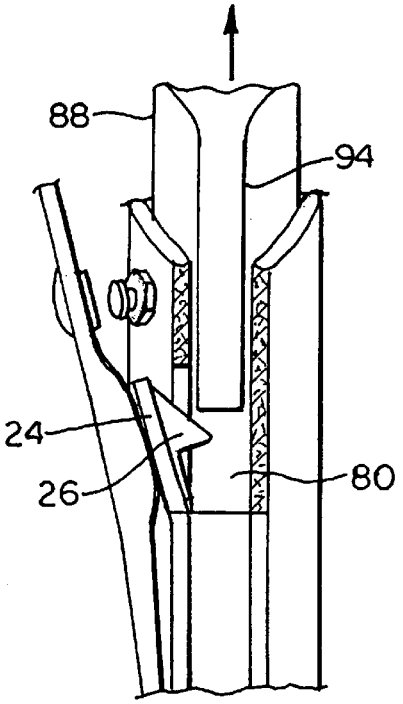

In order to draw handgun 88 from holster cavity 80, paddle 48 is moved to its released position in the manner described with reference to FIG. 4, and arm 24 is returned to its relaxed state. In upwardly drawing handgun 88 from holster cavity 80, as shown in FIG. 8, the above-mentioned portion of trigger guard 94 engages lower surface 26b of boss 26 to push arm 24 outwardly from its position in its relaxed state (as indicated by broken lines). As upward movement of handgun 88 continues, trigger guard 94 clears boss 26 to return arm 24 to its relaxed state, as shown in FIG. 9. Therefore, handgun 88 can be drawn from holster cavity 80 in a straight and upward motion through the open top of the holster body.

Advantages of the invention, as previously discussed in the Summary of the Invention, should be clearly apparent from the above detailed description and referenced drawings.

Obviously, many modifications and variations of the present invention are possible in light of the above teachings. For example, under broad aspects of the invention, the latch (comprising the arm and boss) could be modified so that the upper and lower surfaces of the boss do not extend appreciably into the holster cavity when the arm is in its relaxed state. Therefore, the trigger guard would not engage the boss when inserting the handgun into the holster cavity or drawing the handgun from the holster cavity. It is, therefore, to be understood that within the scope of the appended claims, the invention may be practiced otherwise than as specifically described.

That which is claimed is:

1. A top draw security holster for a handgun having a trigger guard, wherein the security holster is oriented for wearing by a user and comprises:

a holster body having a pair of opposing sidewalls, an open top, a back, and an at least partially closed and unopening front, wherein a holster cavity is defined in the holster body and one one of said sidewalls has a window adjacent to the back of the holster body;

a latch having a flexible and resilient arm integrally connected to said one sidewall adjacent to the window and also having a boss integrally connected to the arm, wherein the arm, when in a relaxed state, extends outwardly from said one sidewall exteriorly of the holster cavity so that at least a portion of the boss is outside of but adjacent to the window; and a latch control means selectively movable between a released position and a latched position, where in the released position the arm is allowed by the latch control means to be in its relaxed state to permit insertion of the handgun into the holster cavity so that the trigger guard is adjacent to the window, and where in moving from the released position to the latched position the latch control means pushes the arm inwardly and the boss inwardly through the window to position the boss inside the trigger guard within the holster cavity so as to prevent drawing of the handgun from the holster cavity, and finally where movement of the latch control means from the latched position back to the released position returns the arm to its relaxed state to allow drawing of the handgun from the holster cavity in a straight and upward motion through the open top of the holster body.

2. A security holster as recited in claim 2 wherein the arm, in its relaxed state, defines an acute angle with respect to the window.

3. A security holster as recited in claim 2 wherein the boss has an upper surface extending through the window and into the holster cavity in the released position and being inclined with respect to the window so as to slope generally downwardly in its extension from the window into the holster cavity, whereby upon insertion of the handgun into the holster cavity the trigger guard engages the upper surface of the boss to push the arm outwardly to thereby allow the trigger guard to clear the boss in its downward movement into the holster cavity.

4. A security holster as recited in claim 2 wherein the boss has a lower surface defining an angle less than or about equal to 90° with respect to the arm.

5. A security holster as recited in claim 4 where in the latched position the arm is approximately parallel to the window and the lower surface of the boss extends into the holster cavity inside the trigger guard, whereby in any attempt to draw the handgun from the holster the lower surface of the boss engages the trigger guard to prevent drawing the handgun from the holster cavity.

6. A security holster as recited in claim 5 where in the latched position, and substantially the entire boss and the lower surface thereof extends into the holster cavity.

7. A security holster as recited in claim 6 wherein the angle defined between the lower surface of the boss and the arm is about equal to 90°.

8. A security holster as recited in claim 4 where after movement of the latch control means from the latched position to the released position the lower surface of the boss extends through the window and is inclined with respect to the window so as to slope generally upwardly in its extension from the window into the holster cavity inside the trigger guard, whereby in upward drawing of the handgun from the holster cavity the trigger guard engages the lower surface of the boss to push the arm outwardly to thereby allow the trigger guard to clear the boss in its upward movement in the holster cavity.

9. A security holster as recited in claim 8 wherein the angle defined between the lower surface of the boss and the arm is about equal to 90°.

10. A security holster as recited in claim 1 wherein the arm comprises a spring steel member interposed between leather layers.

11. A security holster as recited in claim 1 wherein the latch control means comprises an elongated member defining a paddle connected to said one sidewall such that at least a portion of the paddle is positionable over and in contact with the arm and moves inward with respect to said one side wall in going from the released position to the latched position and moves outward with respect to said one sidewall in going from the latched position to the released position.

12. A security holster as recited in claim 11 further comprising a fastener for removably fastening the paddle to said one sidewall in its latched position.

13. A security holster as recited in claim 12 wherein the paddle has an upper end, a lower end pivotally connected to said one sidewall below the window, and an intermediate portion which is that portion positionable over and in contact with the arm, and wherein the fastener comprises a directional snap by which the paddle is selectively unsnapped from its latched position in a substantially rearward movement of the upper end of the paddle by the user.

14. A security holster as recited in claim 13 further comprising a thumb tab affixed to the upper end of the paddle.

15. A security holster as recited in claim 14 further comprising a thumb break strap integrally connected to said one sidewall adjacent to the front of the holster body, a restraining strap integrally connected to the other sidewall adjacent to the front of the holster body, and a fastener for removably fastening the restraining strap to the thumb break strap.

* * * * *